US007918329B2

(12) United States Patent
Araie et al.

(10) Patent No.: US 7,918,329 B2
(45) Date of Patent: Apr. 5, 2011

(54) CONVEYING DEVICE USING ELECTROSTATIC ADSORBING PLATE

(75) Inventors: Hidemasa Araie, Fukui (JP); Kenichi Takashima, Fukui (JP); Susumu Takagi, Fukui (JP)

(73) Assignee: Seiren Co., Ltd, Fukui (JP)

( * ) Notice: Subject to any disclaimer, the term of this patent is extended or adjusted under 35 U.S.C. 154(b) by 658 days.

(21) Appl. No.: 11/990,167

(22) PCT Filed: Aug. 11, 2006

(86) PCT No.: PCT/JP2006/316201

§ 371 (c)(1),
(2), (4) Date: Feb. 8, 2008

(87) PCT Pub. No.: WO2007/020988

PCT Pub. Date: Feb. 22, 2007

(65) Prior Publication Data

US 2010/0133070 A1 Jun. 3, 2010

(30) Foreign Application Priority Data

Aug. 12, 2005 (JP) ..... 2005-234366

(51) Int. Cl.
*B65G 35/00* (2006.01)

(52) U.S. Cl. ..... 198/619; 271/18.1; 414/793.2

(58) Field of Classification Search ..... 198/619, 198/679; 271/18.1, 193, 901; 414/793.2, 414/793.3, 797.1

See application file for complete search history.

(56) References Cited

U.S. PATENT DOCUMENTS

| | | | | |
|---|---|---|---|---|
| 2,193,162 | A * | 3/1940 | Carter | 414/793.2 |
| 3,304,084 | A * | 2/1967 | Ashton | 271/193 |
| 3,831,780 | A * | 8/1974 | Skarin et al. | 271/193 |
| 3,981,406 | A * | 9/1976 | Eldridge et al. | 414/793.2 |
| 4,392,766 | A * | 7/1983 | Blunt | 271/18.1 |
| 4,848,536 | A * | 7/1989 | Machida | 198/619 |
| 4,949,950 | A * | 8/1990 | Stephany | 271/193 |
| 2003/0039536 | A1 * | 2/2003 | Bjorn et al. | 414/793.3 |
| 2004/0089993 | A1 * | 5/2004 | Martin et al. | 271/18.1 |

FOREIGN PATENT DOCUMENTS

| | | |
|---|---|---|
| JP | 58-207230 | 12/1983 |
| JP | 1-104535 | 4/1989 |
| JP | 2002-178288 | 6/2002 |

OTHER PUBLICATIONS

Bio Ind. 2004, vol. 21, No. 3, pp. 46-53.

* cited by examiner

*Primary Examiner* — James R Bidwell
(74) *Attorney, Agent, or Firm* — Dilworth & Barrese, LLP

(57) ABSTRACT

Provided is a low-cost electrostatic attraction transfer apparatus which can perform high-speed transfer, stabilizes a contact status of an electrostatic attraction board with a film and the like and does not generate fine defects on an object to be transferred.

16 Claims, 2 Drawing Sheets a)

b)

CONVEYING DEVICE USING ELECTROSTATIC ADSORBING PLATE

FIELD OF THE INVENTION

The present invention relates to a conveying device for chucking and conveying a relatively thin article such as a film or the like by utilizing an electrostatic force.

BACKGROUND

In connection with an operation for laminating relatively thin filmy materials such as plastic films or pieces of cloth each having a thickness of about 1 mm or less, an operation of taking out filmy materials one by one from a vessel or the like which contains a large number of filmy materials and then conveying them to a working position is performed in various fields. As conventional such conveying means there has been known a vacuum chucking/conveying system which vacuum-chucks and conveys an article with use of a vacuum chucking device comprising a flat plate-like structure and plural vacuum chucks attached thereto. According to this system, however, there has been a fear that the surface of the article being conveyed may be damaged because the article is filmy and thin. In case of the to-be-conveyed article being a screen-like film having a large number of pores, there has been the problem that air leaks from the pores, making the chucking operation difficult.

On the other hand, as is described in JP (U) 54-41892A, there is known an electrostatic holding device wherein plural electrodes are disposed on an insulator layer, a semiconducting adsorbing layer is laminated thereon, then DC voltage is applied to those electrodes, allowing static electricity to be developed on the adsorbing layer, and an article to be adsorbed is absorbed and held by an electrostatic attracting force. If this electrostatic holding device is applied to conveyance, it is possible to effect adsorbing and conveyance without doing any damage to the article being conveyed. This electrostatic holding device is in wide use in the field in which a fine defect exerts a great influence on product yield, for example in the case of semiconductor wafers, optical glass and films.

In connection with the adsorbing method in the electrostatic adsorbing/conveying system, in JP 2003-282671A and JP2004-120921A there is disclosed a method wherein a pair or plural pairs of electrodes are arranged side by side at fine pitches and voltages opposite in polarity are applied thereto and controlled, allowing only the top of plural laminated to-be-conveyed articles to float or be absorbed efficiently.

In connection a method for peeling a conveyed article in the electrostatic adsorbing/conveying system, in JP 6-71944B there is disclosed a method wherein DC and AC power supplies are used as applied voltage sources and, after turning OFF the power, the electricity remaining on the article is decreased quickly, causing the article to be separated quickly.

In JP 2003-285289A there is disclosed a method wherein electrodes are arranged on an insulating material having flexibility and having concaves and convexes on the bottom surface thereof, thereby intending to improve the positional accuracy of a to-be-conveyed article during chucking or separation.

However, according to the method disclosed in JP 2003-282671A and JP 2004-120921A, it is necessary to provide a controller for controlling the applied voltage to an optimum level at all times. As a result, the device becomes expensive in comparison with an electrostatic adsorbing device of a constant applied voltage type.

According to an embodiment described in JP 6-71944B, several seconds are required for separating a conveyed article from an adsorbing plate and thus in the filed requiring high-speed conveyance there remains a problem in point of conveyance efficiency. In the method disclosed in JP 2003-285289A, since a flexible adsorbing plate is used, the state of contact between the adsorbing plate and the article being conveyed is not constant, resulting in that there occurs a difference in contact pressure of the adsorbing plate for the article at the time of adsorbing or separation. In his case, there is a tendency that rubbing damage, contact damage, or texture offsetting, occurs for a product whose yield is greatly influenced by a fine defect.

OBJECTS OF THE INVENTION

It is an object of the present invention to solve the above-mentioned problems of the conventional conveying devices and provide an electrostatic adsorbing/conveying device capable of performing high-speed conveyance, capable of keeping constant the state of contact between an electrostatic adsorbing plate and a filmy article to be conveyed, causing no fine defect or the like to be developed on the article to be conveyed, and being inexpensive.

SUMMARY OF THE INVENTION

According to the present invention there is provided a conveying device comprising an electrostatic adsorbing plate, the electrostatic adsorbing plate having an electrode portion in the interior thereof, and a voltage applying portion for applying voltage to the electrode portion, wherein an article to be conveyed is adsorbed and conveyed by utilizing an electrostatic force induced by applying voltage to the electrode portion from the voltage applying portion, characterized in that a peeling plate having a multitude of apertures is disposed on the article to be conveyed side with respect to the electrostatic chucking plate, the peeling plate being mounted in such a manner that one surface thereof can repeat a contact state and a non-contact state between it and a surface of the electrostatic adsorbing plate, and the surface of the electrostatic adsorbing plate is inclined relative to a surface of the article to be conveyed.

It is preferable that the peeling plate be formed of an insulating material and that the percentage of voids of the peeling plate be 50% or more.

Further, the angle of inclination between the surface of the electrostatic adsorbing plate and that of the article to be conveyed is preferably in the range of 1 to 45 degrees.

EFFECTS OF THE INVENTION

According to the present invention, if in an adsorbing stage the electrostatic adsorbing plate performs an operation of adsorbing an article to be conveyed while maintaining a predetermined angle relative to the article, only the top of plural laminated articles can be adsorbed efficiently even in a constant applied voltage condition.

Moreover, in a peeling stage, by separating the surface of the peeling plate and that of the electrostatic adsorbing plate from each other, it becomes possible to sufficiently decrease the electrostatic adsorbing force exerted on the conveyed article, thus permitting quick separation of the article. Additionally, it is possible to prevent the occurrence of such defects as rubbing damage, contact damage and texture offsetting which have so far occurred upon removal of the electrostatic adsorbing force, whereby the positioning accuracy is further improved.

EMBODIMENTS OF THE INVENTION

The present invention will be described in detail hereinunder.

As the electrostatic adsorbing plate, a conventional known electrostatic adsorbing plate may be used in a fixed state to a suitable support base. Various types of electrostatic adsorbing plates are available, using ceramics, polyimides and other general-purpose plastic materials (e.g., polyvinyl chloride, polymethyl methacrylate, polystyrene, polyethylene and polyisobutylene) as insulating layer materials. In the case where the electrostatic adsorbing plate is to be used in an environment other than special environments, the use of a general-purpose plastic material suffices.

As the electrode portion which is a constituent of the electrostatic adsorbing plate, no matter which of unipolar type and bipolar type may be used, it will do. Preferably, the electrode portion is composed of electrodes A and B. The electrodes A and B are arranged in a large number at fine pitches through insulating regions and an article to be conveyed is held by utilizing an electrostatic force which is induced by applying voltage of the same polarity (unipolar) to the electrodes or applying voltages opposite in polarity (bipolar) to the electrodes. The applied voltage is preferably DC voltage of 500V to 5,000V. If the applied voltage is lower than 500V, it will become difficult to attain a satisfactory electrostatic adsorbing effect. If the applied voltage exceeds 5,000V, the article to be conveyed is apt to be wrinkled or damaged under the action of an excessive electrostatic force in electrostatic adsorbing.

The electrostatic adsorbing plate is disposed inclinedly relative to to-be-conveyed articles which are superimposed at rest in a large number substantially horizontally. The angle of this inclination is preferably in the range of 1° to 45°, more preferably 5° to 20°. If the inclination angle is smaller than 1°, an electrostatic force will act on the whole of the articles to be conveyed and it will become difficult to adsorb only the top one out of plural laminated articles, with a fear of dislocation of the next article. If the inclination angle is larger than 45°, the electrostatic force acting on the articles to be conveyed will become small, with a consequent fear of deficiency of the adsorbing ability.

The peeling plate is usually made up of a peeling portion which is put in contact with the article to be conveyed and a frame portion which supports the peeling portion. As the peeling portion there is used a relatively thin electrically insulating material such as thin plate, film, sheet, screen or plain gauze having a large number of apertures. It is preferable to use a peeling plate obtained by stretching a tape, ribbon or yarn of a narrow width made of an insulating material planarly throughout the inside of a frame. An electrically conductive material such as metal is also employable, but in this case it is preferable to increase the percentage of voids because an electrostatic force developed on the adsorbing plate would be shielded. As the insulating material there may be used, for example, polytetrafloroethylene, polypropylene, polyethylene terephthalate, nylon, or polyethylene. By using such a material, the electrostatic force of the electrostatic adsorbing plate acts on the article to be conveyed without attenuation. As to the material constituting the frame portion which supports the peeling portion, no limitation is made thereto insofar as the material used has a strength suitable for use.

The peeling plate is fixed movably so that their opposed surfaces are in contact in adsorbing operation and become out of contact with each other in peeling operation. As an example of such a contact/non-contact mechanism, mention may be made of a construction wherein one sides of their frame portions are fixed as rotary shafts to permit a rotational motion like opening and closing of a door. The mechanism in question is not specially limited. For example, there may be used a cylinder which utilizes air pressure or oil pressure, or there may be used a motor or the like to generate rotation. When adsorbing and conveying the article to be conveyed, the peeling plate is in contact with the electrostatic adsorbing plate and the article to be conveyed is held with a sufficient electrostatic adsorbing force, while in peeling operation, the article can be peeled off from the electrostatic adsorbing plate by causing a partial rotational motion about a shaft portion. It is preferable that the rotational shaft portion be the lowest side of the inclined electrostatic adsorbing plate.

Another example of the contact/non-contact mechanism is a method wherein cylinders or guide rails are disposed respectively at vertices of quadrangular electrostatic adsorbing plate and peeling plate and one or both are slid. No matter what method may be adopted, it is optional which of the peeling plate and the electrostatic adsorbing plate is to operate, or both may operate.

Aperture pattern of the peeling plate is not specially limited. For example, it may be circular, lattice-like, or slit-like. However, the pore pattern is preferably a uniform pattern. The percentage of voids is preferably 50% or more, more preferably 80% or more. If the percentage of voids is less than 50%, the even if the voltage applied to the electrostatic adsorbing plate is cut off, an electrostatic force remains on the peeling plate and it is impossible to peel off the conveyed article quickly, with a fear of lowering of the conveyance efficiency. As a method for forming a large number of apertures in the peeling plate, a large number of apertures of an arbitrary pattern may be formed beforehand at the time of molding of the peeling plate, or small holes may be formed in a sheet or film of the foregoing insulating material by arbitrary means. There also may be adopted a method wherein a tape, ribbon or yarn of a narrow width formed of the foregoing insulating material is stretched at suitable intervals throughout a frame portion.

The electrostatic adsorbing/conveying device of the present invention is suitable for the conveyance of a filmy article capable of being adsorbed electrostatically such as plastic film, cloth and paper. The adsorbing plate and the peeling plate may each be disposed in a divided fashion into several portions in accordance with the size of the article to be conveyed. Also as to their shape, not only a quadrangular shape, but also circular and polygonal shapes will do.

The conveying device of the present invention is used in an attached state to suitable moving means.

The operation of the electrostatic adsorbing/conveying device of the present invention will now be described with reference to FIG. 1. FIG. 1 shows an example of the conveying device according to the present invention. An electrostatic adsorbing plate 1 approaches articles 4 to be conveyed from above with a peeling plate 2 interposed therebetween, the articles 4 being laminated in a plural number over a substantially horizontal plane. At this time it is preferable that the peeling plate 2 be in close contact with the electrostatic adsorbing plate 1. Since the electrostatic adsorbing plate 1 is inclined relative to the articles 4 to be conveyed, the spacing between the two differs in accordance with the inclination. If voltage is applied to an electrode portion (not shown), an electrostatic force induced between the electrostatic adsorbing plate and the articles 4 also becomes strong or weak in accordance with the spacing between the two. Therefore, the article 4 positioned on the top of narrow spacing is the first to be adsorbed by the electrostatic adsorbing plate 1 and eventually all the articles 4 are adsorbed by the electrostatic adsorbing plate 1 through the peeling plate 2. According to such an adsorbing procedure, the laminated articles can be adsorbed positively one by one. In other words, it is possible to prevent the simultaneous adsorption of plural articles or prevent dislocation of the second and subsequent articles. Besides, the article when adsorbed is not wrinkled.

Next, the peeling operation will be described with reference to FIG. 2 A). After adsorbing and conveying the article 4, the electrostatic adsorbing plate 1 and the peeling plate 2 are brought down to a predetermined position and the peeling plate 2 is rotated partially into a horizontal state with a shaft (not shown) as a center. During the peeling operation, the electrostatic adsorbing plate 1 may be in a voltage applied state or cut-off state. Since the peeling plate 2 separates from the electrostatic adsorbing plate 1, the electrostatic adsorbing force acting on the article 4 decreases and the residual charging time of the peeling plate 2 becomes short, so that the article 4 is peeled off quickly, with no contact damage to the article. In this way the article 4 can be conveyed and moved accurately.

In the side views of FIGS. 1 and 3 and in FIG. 2, a horizontal plane is shown as a vertical plane for convenience sake.

EXAMPLES

As an electrostatic adsorbing plate there was used "Kyulon" (registered trademark) (bipolar type) (a product of Taihei Chemicals Ltd.). Eight electromagnetic adsorbing plates each having a surface dimension of 220 mm×260 mm (A4 size) were arranged as in FIG. 3 and were provided with support portions on their upper surfaces and joined to a robot actuator so as to be movable vertically and transversely. Such a peeling plate as shown in FIG. 4 was fabricated and disposed on a lower surface (an article contacting surface) of each electrostatic adsorbing plate. By means of a reversible motor the peeling plate can perform a rotational motion with a long side thereof as a shaft.

In the following working examples and comparative examples an electromagnetic wave shielding screen for plasma display panel was used as an article to be conveyed. The electromagnetic wave shielding screen can be obtained by applying an electrically conducting treatment to a thin mesh-like fabric which has been produced by weaving 30 μm dia. polyester monofilament into a warp density of 135 pc./in. and a weft density of 135 pc./in. The thick mesh-like fabric obtained by the electrically conducting treatment was cut into a size of 700 mm long by 1000 mm wide and a bias angle of 20°. Fifty pieces of the fabric were laminated and placed as articles to be conveyed on a substantially horizontal stage.

Variations in the conveying position were evaluated in the following manner. When the electrostatic adsorbing plates adsorb and convey each article to be conveyed and retracts after peeling the article, the spacing between an end-side position of the article and a reference point was measured on the order of millimeter. The conveyance was repeated fifty times for the articles to be conveyed and thus the measurement was conducted fifty times, then variations were calculated. The smaller the positional variations (σ50), the better. Values not larger than 5 were judged to be good.

Example 1

The electrostatic adsorbing plates were arranged at an inclination angle of 10° relative to a horizontal plane and a peeling plate (FIG. 4*a*)) was fabricated by arranging 200 μm dia. nylon monofilament yarn in a lateral stripe shape into a percentage of voids of 95%, then was attached to a stainless steel frame having 300 mm×600 mm apertures. When voltage of 3,000V was applied to the electrostatic adsorbing plates, an adsorbing force was found to be 5 kgf. A conveyance test was conducted using this conveying device, the results of which are shown in Table 1.

Example 2

Using a conveying device of the same construction as in Example 1, voltage of 1,000V was applied to the electrostatic adsorbing plates to find that an adsorbing force was 3 kgf. Under this condition there was conducted a conveyance test, the results of which are shown in Table 1.

Example 3

The electrostatic adsorbing plates were arranged at an inclination angle of 5° relative to a horizontal plane and a peeling plate was fabricated by arranging 200 μm dia. polyester monofilament yarn in a lattice shape into a percentage of voids of 90% (FIG. 4*b*)), then was attached to a stainless steel frame having 300 mm×600 mm apertures. When voltage of 3,000V was applied to the electrostatic adsorbing plates, an adsorbing force was found to be 5 kgf. A conveyance test was conducted using this conveying device, the results of which are shown in Table 1.

Comparative Example 1

The electrostatic adsorbing plates were arranged in parallel (inclination angle 0°) with a horizontal plane and a peeling plate (FIG. 4*a*)) was fabricated by arranging 200 μm nylon monofilament yarn in a lateral stripe shape into a percentage of voids of 95%, then was attached to a stainless steel frame having 300 mm×600 mm apertures.

When voltage of 3,000V was applied to the electrostatic adsorbing plates, an adsorbing force was found to be 5 kgf. A conveyance test was conducted using this adsorbing device, the results of which are shown in Table 1.

Comparative Example 2

The electrostatic adsorbing plates were arranged at an inclination angle of 10° relative to a horizontal plane and a 1 mm thick aperture-free aluminum plate was attached to a stainless steel frame having 300 mm×600 mm apertures. Using this conveying device, voltage of 3,000V was applied to the electrostatic adsorbing plates and a conveyance test was conducted, the results of which are shown in Table 1.

TABLE 1

| | Example 1 | Example 2 | Example 3 | Comparative Example 1 | Comparative Example 2 |
|---|---|---|---|---|---|
| Applied voltage, V | 3,000 | 1,000 | 3,000 | 3,000 | 3,000 |
| Adsorbing force, kgf | 5 | 3 | 5 | 5 | 5 |

TABLE 1-continued

| | Example 1 | Example 2 | Example 3 | Comparative Example 1 | Comparative Example 2 |
|---|---|---|---|---|---|
| Inclination angle, deg | 10 | 10 | 5 | 0 | 10 |
| Material of peeling portion | Nylon yarn | Nylon yarn | Polyester yarn | Nylon yarn | Aluminum plate |
| Pattern of peeling portion | Lateral stripe | Lateral stripe | Lattice | Lateral stripe | Aperture-free |
| Percentage voids of peeling portion, % | 95 | 95 | 90 | 95 | 0 |
| Positional variations, σ50 | 2 | 3 | 2 | 18 | — |
| Conveying performance | Good | Good | Good | Adsorbed plural sheets | Failed to adsorb and convey |

Figure 1:
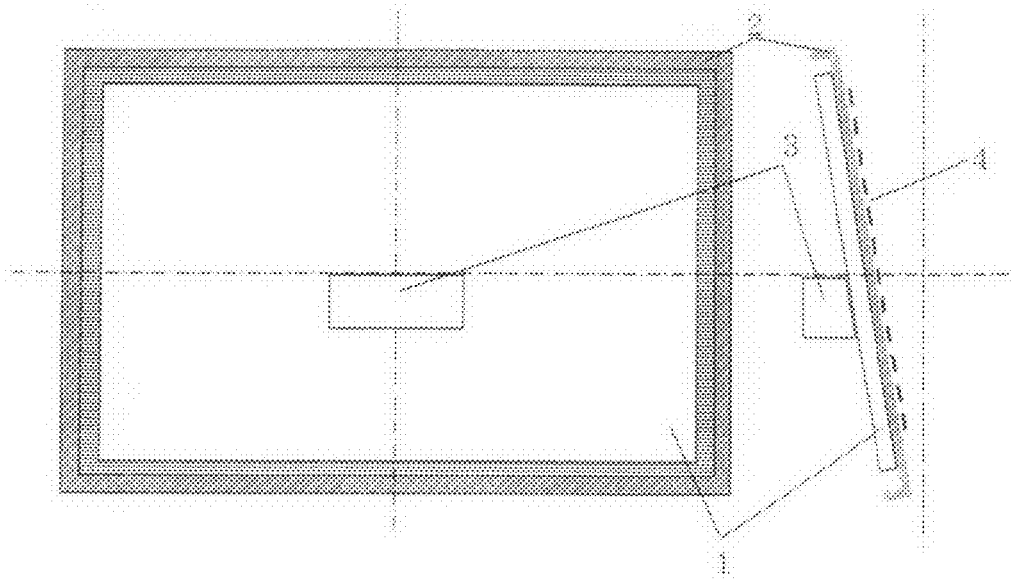
FIG. 1 comprises a top view and a side view, showing an example of the electrostatic adsorbing/conveying device according to the present invention and showing an article adsorbed or conveying state.
Figure 2:
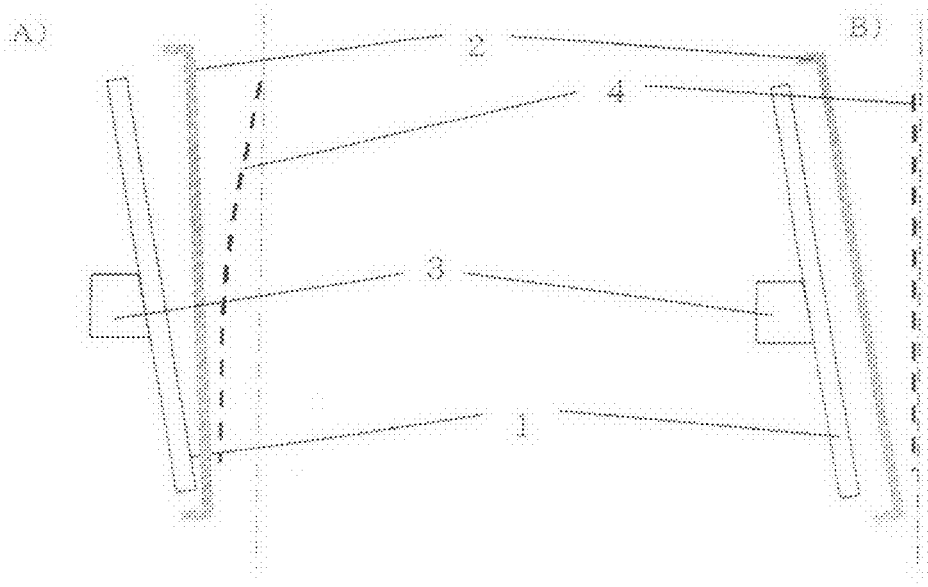
FIG. 2 is a side view showing an example of the electrostatic adsorbing/conveying device according to the present invention and showing an article peeling state, in which A) shows an example of a peeling plate rotating and separating from an electrostatic adsorbing plate and B) shows an example of an electrostatic adsorbing plate sliding upward and separating from a peeling plate.
Figure 3:
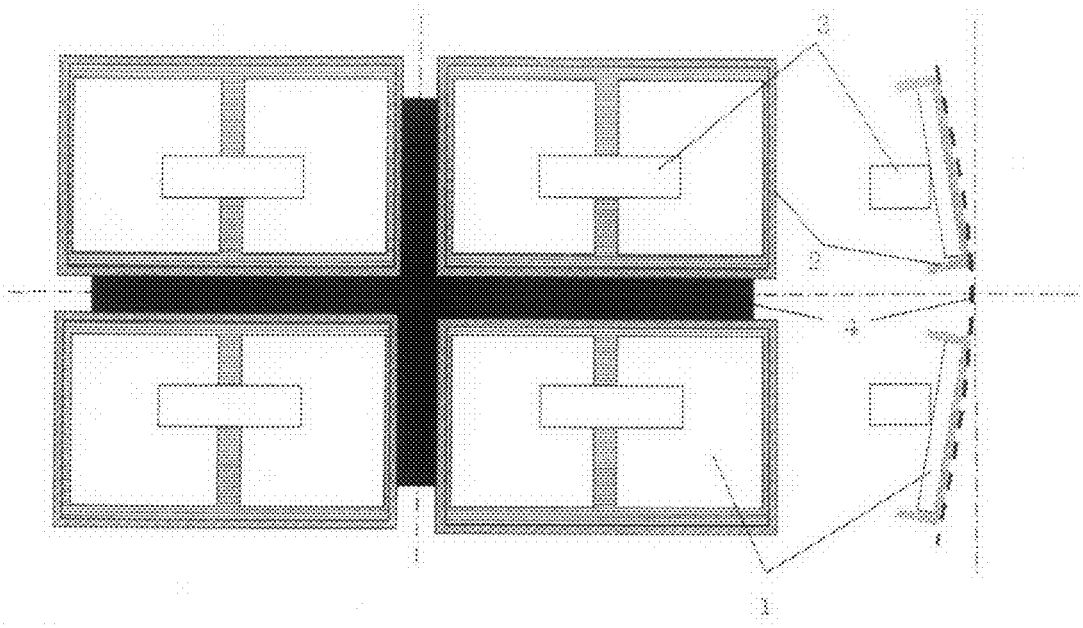
FIG. 3 comprises a top view and a side view, showing an example of the electrostatic adsorbing/conveying device according to the present invention.
Figure 4:
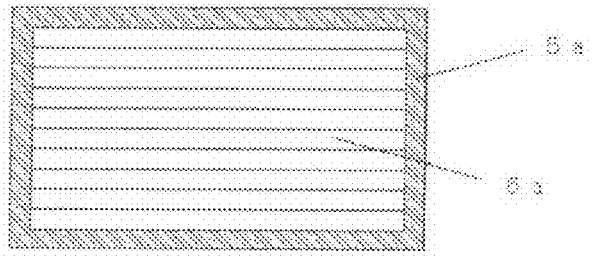
FIG. 4 is a diagram showing examples of the peeling plate shape, in which a) shows an example of yarn stretched in a lateral stripe shape and b) shows an example of yarn stretched in a lattice shape.
Figure 4:
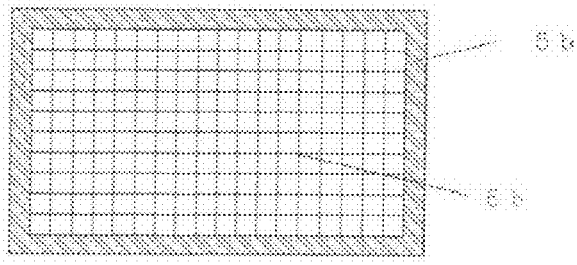

In the drawings, numeral 1 denotes an electrostatic adsorbing plate, 2 a peeling plate, 3 a support base, 4 an article to be conveyed, 5*a*, 5*b* frame portions, and 6*a*, 6*b* peeling portions.

What is claimed is:

1. A conveying device comprising an electrostatic adsorbing plate, said electrostatic adsorbing plate having an electrode portion in the interior thereof, and a voltage applying portion for applying voltage to said electrode portion, wherein an article to be conveyed is adsorbed and conveyed by utilizing an electrostatic force induced by applying voltage to said electrode portion from said voltage applying portion, wherein a peeling plate having a multitude of apertures is disposed on the article to be conveyed side with respect to said electrostatic adsorbing plate, said peeling plate being mounted in such a manner that one surface thereof can repeat a contact state and a non-contact state between it and a surface of said electrostatic adsorbing plate, and the surface of said electrostatic adsorbing plate is inclined relative to a surface of the article to be conveyed.

2. A conveying device according to claim 1, wherein said peeling plate is formed of an insulating material.

3. A conveying device according to claim 1, wherein the percentage of voids of said peeling plate is 50% or more.

4. A conveying device according to claim 1, wherein the angle of inclination between the surface of the electrostatic adsorbing plate and that of the article to be conveyed is in the range of 1 to 45 degrees.

5. A conveying method comprising, when conveying each of a multitude of stacked filmy articles to be conveyed, disposing the conveying device described in claim 1 over said articles to be conveyed in a contacted state of the electrostatic adsorbing plate with the peeling plate and inclinedly relative to a surface of each of said articles to be conveyed, adsorbing the article positioned at the top electrostatically, conveying it to a predetermined position, bringing the electrostatic adsorbing plate and the peeling plate into a non-contact state, separating the thus conveyed article from the conveying device, and repeating a series of these operations.

6. A conveying device according to claim 2, wherein the percentage of voids of said peeling plate is 50% or more.

7. A conveying device according to claim 6, wherein the angle of inclination between the surface of the electrostatic adsorbing plate and that of the article to be conveyed is in the range of 1 to 45 degrees.

8. A conveying device according to claim 3, wherein the angle of inclination between the surface of the electrostatic adsorbing plate and that of the article to be conveyed is in the range of 1 to 45 degrees.

9. A conveying device according to claim 2, wherein the angle of inclination between the surface of the electrostatic adsorbing plate and that of the article to be conveyed is in the range of 1 to 45 degrees.

10. A conveying method comprising, when conveying each of a multitude of stacked filmy articles to be conveyed, disposing the conveying device described in claim 9 over said articles to be conveyed in a contacted state of the electrostatic adsorbing plate with the peeling plate and inclinedly relative to a surface of each of said articles to be conveyed, adsorbing the article positioned at the top electrostatically, conveying it to a predetermined position, bringing the electrostatic adsorbing plate and the peeling plate into a non-contact state, separating the thus conveyed article from the conveying device, and repeating a series of these operations.

11. A conveying method comprising, when conveying each of a multitude of stacked filmy articles to be conveyed, disposing the conveying device described in claim 8 over said articles to be conveyed in a contacted state of the electrostatic adsorbing plate with the peeling plate and inclinedly relative to a surface of each of said articles to be conveyed, adsorbing the article positioned at the top electrostatically, conveying it to a predetermined position, bringing the electrostatic adsorbing plate and the peeling plate into a non-contact state, separating the thus conveyed article from the conveying device, and repeating a series of these operations.

12. A conveying method comprising, when conveying each of a multitude of stacked filmy articles to be conveyed, disposing the conveying device described in claim 7 over said articles to be conveyed in a contacted state of the electrostatic adsorbing plate with the peeling plate and inclinedly relative to a surface of each of said articles to be conveyed, adsorbing the article positioned at the top electrostatically, conveying it to a predetermined position, bringing the electrostatic adsorbing plate and the peeling plate into a non-contact state, separating the thus conveyed article from the conveying device, and repeating a series of these operations.

13. A conveying method comprising, when conveying each of a multitude of stacked filmy articles to be conveyed, disposing the conveying device described in claim 6 over said articles to be conveyed in a contacted state of the electrostatic adsorbing plate with the peeling plate and inclinedly relative to a surface of each of said articles to be conveyed, adsorbing the article positioned at the top electrostatically, conveying it to a predetermined position, bringing the electrostatic adsorbing plate and the peeling plate into a non-contact state, separating the thus conveyed article from the conveying device, and repeating a series of these operations.

14. A conveying method comprising, when conveying each of a multitude of stacked filmy articles to be conveyed, disposing the conveying device described in claim 4 over said articles to be conveyed in a contacted state of the electrostatic adsorbing plate with the peeling plate and inclinedly relative to a surface of each of said articles to be conveyed, adsorbing the article positioned at the top electrostatically, conveying it to a predetermined position, bringing the electrostatic adsorbing plate and the peeling plate into a non-contact state, separating the thus conveyed article from the conveying device, and repeating a series of these operations.

15. A conveying method comprising, when conveying each of a multitude of stacked filmy articles to be conveyed, disposing the conveying device described in claim 3 over said articles to be conveyed in a contacted state of the electrostatic adsorbing plate with the peeling plate and inclinedly relative to a surface of each of said articles to be conveyed, adsorbing the article positioned at the top electrostatically, conveying it to a predetermined position, bringing the electrostatic adsorbing plate and the peeling plate into a non-contact state, separating the thus conveyed article from the conveying device, and repeating a series of these operations.

16. A conveying method comprising, when conveying each of a multitude of stacked filmy articles to be conveyed, disposing the conveying device described in claim 2 over said articles to be conveyed in a contacted state of the electrostatic adsorbing plate with the peeling plate and inclinedly relative to a surface of each of said articles to be conveyed, adsorbing the article positioned at the top electrostatically, conveying it to a predetermined position, bringing the electrostatic adsorbing plate and the peeling plate into a, non-contact state, separating the thus conveyed article from the conveying device, and repeating a series of these operations.

* * * * *